US006287398B1

(12) United States Patent
Smith et al.

(10) Patent No.: US 6,287,398 B1
(45) Date of Patent: Sep. 11, 2001

(54) HIGH STRENGTH ALLOY TAILORED FOR HIGH TEMPERATURE MIXED-OXIDANT ENVIRONMENTS

(75) Inventors: Gaylord Darrell Smith, Huntington, WV (US); Norman Farr, Hereford (GB); Brian Allen Baker, Kitts Hill, OH (US)

(73) Assignee: Inco Alloys International, Inc., Huntington, WV (US)

( * ) Notice: Subject to any disclaimer, the term of this patent is extended or adjusted under 35 U.S.C. 154(b) by 0 days.

(21) Appl. No.: 09/208,319

(22) Filed: Dec. 9, 1998

(51) Int. Cl.[7] ..... C22C 19/05; C22C 19/03

(52) U.S. Cl. ..... 148/428; 148/312; 148/409; 148/410; 148/426; 420/441; 420/442; 420/443

(58) Field of Search ..... 148/409, 410, 148/428, 312, 427, 426, 429; 420/443, 446, 447, 449, 441, 442, 445, 452, 459, 460

(56) References Cited

U.S. PATENT DOCUMENTS

| | | | | |
|---|---|---|---|---|
| 4,248,629 | | 2/1981 | Pons et al. | 75/122 |
| 4,312,682 | * | 1/1982 | Herchenroeder | 148/2 |
| 4,762,681 | | 8/1988 | Tassen et al. | 420/443 |
| 5,403,547 | * | 4/1995 | Smith et al. | 420/581 |
| 5,529,642 | * | 6/1996 | Sugahara et al. | 148/427 |

FOREIGN PATENT DOCUMENTS

| | | |
|---|---|---|
| 0269973 | 6/1988 | (EP) . |
| 549286 | 6/1995 | (EP) . |
| 812926 | 12/1997 | (EP) . |
| 63096235 | 4/1988 | (JP) . |

* cited by examiner

*Primary Examiner*—Roy King
*Assistant Examiner*—Harry D Wilkins, III
(74) *Attorney, Agent, or Firm*—Robert F. Dropkin, Esq.; Webb Ziesenheim Logsdon Orkin & Hanson, P.C.

(57) ABSTRACT

A high strength nickel-base alloy consisting essentially of, by weight percent, 50 to 60 nickel, 19 to 23 chromium, 18 to 22 iron, 3 to 4.4 aluminum, 0 to 0.4 titanium, 0.05 to 0.5 carbon, 0 to 0.1 cerium, 0 to 0.3 yttrium, 0.002 to 0.4 total cerium plus yttrium, 0.0005 to 0.4 zirconium, 0 to 2 niobium, 0 to 2 manganese, 0 to 1.5 silicon, 0 to 0.1 nitrogen, 0 to 0.5 calcium and magnesium, 0 to 0.1 boron and incidental impurities. The alloy forms 1 to 5 mole percent $Cr_7C_3$ after 24 hours at a temperature between 950 and 1150° C. for high temperature strength.

10 Claims, 4 Drawing Sheets

HIGH STRENGTH ALLOY TAILORED FOR HIGH TEMPERATURE MIXED-OXIDANT ENVIRONMENTS

This invention relates to nickel-chromium alloys having high strength and oxidation resistance at high temperatures.

BACKGROUND OF THE INVENTION

Commercial alloys provide good resistance to carburization and oxidation to temperatures of the order of 1000° C. (1832° F.). How, where, where higher temperatures are combined with severe mixed oxidant environments under high-load conditions, the availability of affordable alloys meeting all the material requirements becomes virtually nil. The failure of commercial alloys to perform at these elevated temperatures can be traced to solutioning of the strengthening phases. The solutioning of these phases lowvers strength and leads to the loss of performance of the protective scales on the alloy due to such mechanisms as scale spallation, scale vaporization or loss of the ability to inhibit or retard cation or anion diffusion through the scale.

Pyrolysis tubing suitable for producing hydrogen from volatile hydrocarbons must operate for years at temperatures in excess of 1000° C. (1832° F.) under considerable uniaxial and hoop stresses. These pyrolysis tubes must form a protective scale under normal operating conditions and be resistant to spallation during shutdowns. Furthermore, normal pyrolysis operations include the practice of periodically burning out carbon deposits within the tubes in order to maintain thermal efficiency and production volume. The cleaning is most readily accomplished by increasing the oxygen partial pressure of the atmosphere within the tubes to burn out the carbon as carbon dioxide gas and to a lesser extent carbon monoxide gas.

Pyrolysis tubes' carbon deposits however, seldom consist of pure carbon. They usually consist of complex solids containing carbon, hydrogen and varying amounts of nitrogen, oxygen, phosphorus and other elements present in the feedstock. Therefore, the gas phase during burnout is also a complex mixture of these clements, containing various product gases, water vapor, nitrogen and nitrogenous gases. A further factor is that the formation of carbon dioxide gases is strongly exothermic. The xothermicity of this reaction is further enhanced by the hydrogen content of the carbon deposit. Thus, although it is standard practice to control the oxygen partial pressure during carbon burnout in order to prevent runaway temperatures, variations in the character of the carbon deposits can lead to so-called "hot spots", i.e., sites hotter than average and "cold spots" i.e., sites cooler than average. Thus, pyrolysis tube alloys over their lifetime are exposed to a broad spectrum of corrosive constituents over a wide range of temperatures. It is for this reason that an alloy is needed that is immune to degradation and loss of strength under these fluctuating conditions of temperature and corrosive constituents.

Aside from considerations involved in the oxygen partial pressure during carbon burnout, there is a great range of oxygen partial pressures which can be expected in service in such uses as heat treating, coal conversion and combustion, steam hydrocarbon reforming and olefin production. For greatest practical use, an alloy should have carburization resistance not only in atmospheres where the partial pressure of oxygen favors chromia ($Cr_2O_3$) formation but also in atmospheres that are reducing to chromia and favor the formation of $Cr_7C_3$. In pyrolysis furnaces, for example, where the process is a non-equilibrium one, at one moment the atmosphere might have a log of $PO_2$ of−19 atmospheres (atm) and at another moment the log of $PO_2$ might be −23 atm or so. Such variable conditions, given that the log of $PO_2$ for $Cr_7C_3$—$Cr_2O_3$ crossover is about −20 atm at 1000° C. (1832° F.), require an alloy which is universally carburization resistant.

It is an object of this invention to provide an alloy suitable for pyrolysis of hydrocarbon at temperatures in excess of 1000° C.

It is a further object of this invention to provide an alloy resistant to the corrosive gases produced during carbon burnout of pyrolysis tubes.

It is a further object of this invention to provide an alloy at oxygen partial pressures that favor formation of chomia and pressures reducing to chromia.

SUMMARY OF THE INVENTION

A high strength nickel-base alloy consisting essentially of, by weight percent, 50 to 60 nickel, 19 to 23 chromium, 18 to 22 iron, 3 to 4.4 aluminum, 0 to 0.4 titanium, 0.05 to 0.5 carbon, 0 to 0.1 cerium, 0 to 0.3 yttrium, 0.002 to 0.4 total cerium plus yttrium, 0.0005 to 0.4 zirconium, 0 to 2 niobium, 0 to 2 manganese, 0 to 1.5 silicon, 0 to 0.1 nitrogen, 0 to 0.5 calcium and magnesium, 0 to 0.1 boron and incidental impurities. This alloy forms 1 to 5 mole percent $Cr_7C_3$ after 24 hours at a temperature between 950 and 1150° C. for high temperature strength.

DESCRIPTION OF PREFERRED EMBODIMENTS

Figure 1:
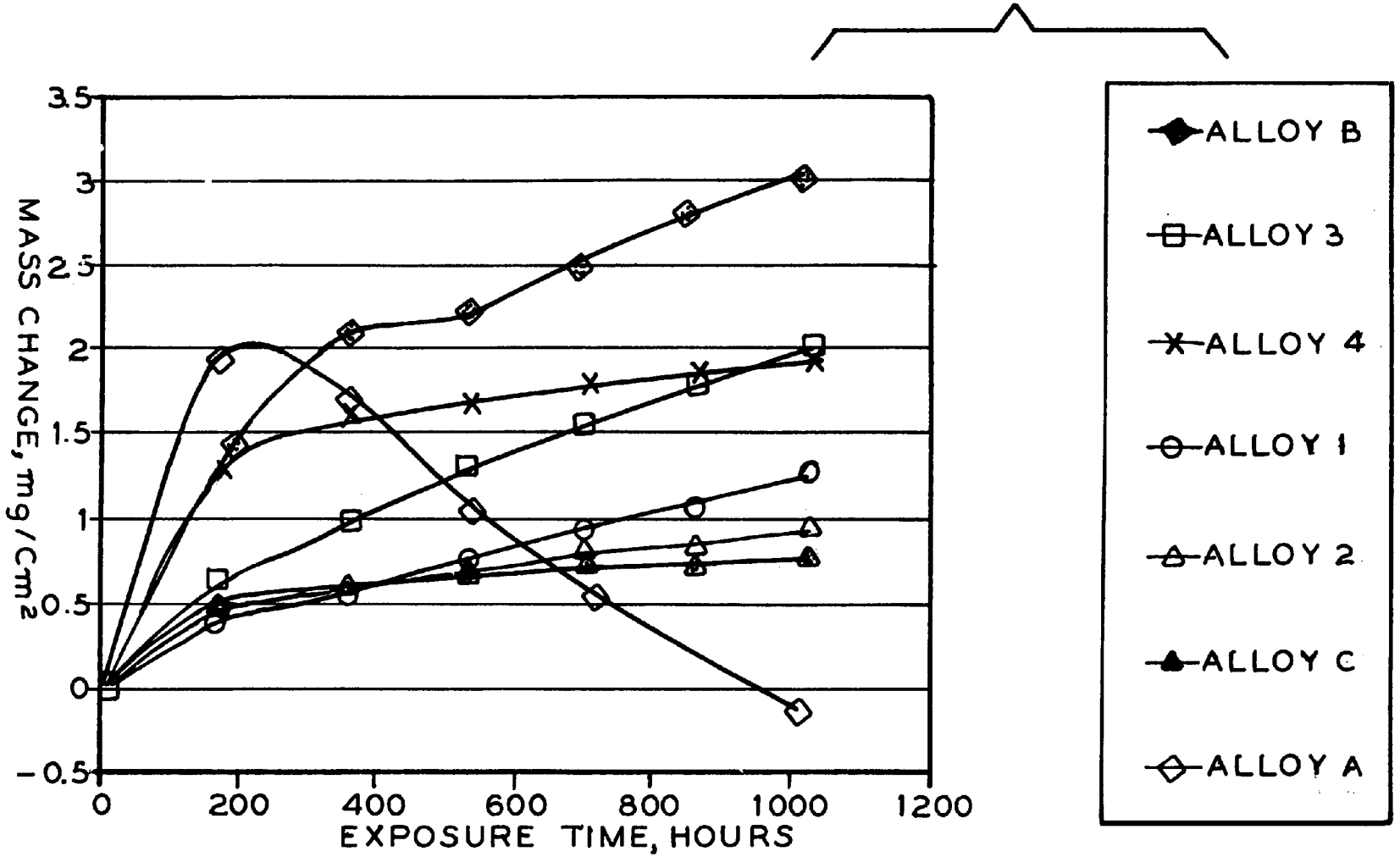
FIG. 1 compares mass change of alloys in air -5% $H_2O$ at a temperature of 1000° C.

The strengthening mechanism of the alloy range is surprisingly unique and ideally suited for high temperature service. The alloy strengthens at high temperature by precipitating a dispersion of 1 to 5 mole percent granular type $Cr_7C_3$. This can be precipitated by a 24 hour heat treatment at temperatures between 950° C. (1742° F.) and 1150° C. (2102° F.). Once formed, the carbide dispersion is stable from room temperature to virtually its melting point. At intemiediate temperatures, less than 2% of the alloy's contained carbon is available for the precipitation of film-forming $Cr_{23}C_6$ following the $Cr_7C_3$ precipitation anneal. This ensures maximum retention of intermediate temperature ductility. Advantageously, fabricating the alloy into final shape before precipitating the majority of the $Cr_7C_3$ simplifies working of the alloy. Furthennore, the high temperature use of the alloy will often precipitate this strengthening phase during use of the alloy.

While the alloy is not necessarily intended for intenmediate temperature service, the alloy can be age hardened through the precipitation of 10 to 35 mole percent of $Ni_3Al$ over the temperature range 500° C. (932° F.) to 800° C. (1472° F.). The alloy is also amenable to dual temperature aging treatments. The high temperature stress rupture life of this alloy is advantageously greater than about 200 hours or more at a stress of 13.8 MPa (2 ksi) and at a temperature of 982° C. (1 800° F.).

The nickel-chromium base alloys is adaptable to several production techniques, i.e., melting, casting and working, e.g., hot working or hot working plus cold working to standard engineering shapes such as rod, bar, tube, pipe, sheet, plate, etc. In respect to fabrication, vacuum melting, optionally followed by either electroslag or vacuum are remelting, is recommended. Because of the composition of the alloy range, a dual solution anneal is recommended to maximize solution of the elements. A single high temperature anneal may only serve to concentrate the aluminum as a low melting, brittle phase in the grain boundaries. Whereas, an initial anneal in the range of 1100° C. (2012° F.) to 1150° C. (2102° F.) serves to diffuse the aluminum away from the grain boundary. After this, a higher temperature anneal advantageously maximizes the solutionizing of all elements. Times for this dual step anneal can vary from 1 to 48 hours depending on ingot size and composition.

Following solution annealing, hot working over the range of 982° C. (1800° F.) to 1150° C. (2102° F.) forms the alloys into useful shapes. Intermediate and final anneals, advantageously performed within the temperature range of about 1038° C. (1900° F.) to 1204° C. (2200° F.), detennine the desired grain size. Generally, higher annealing temperatures produce larger grain sizes. Times at temperature of 30 minutes to one hour usually are adequate, but longer times are easily accommodated.

In carrying this range of alloys into practice, it is preferred that the chromium content not exceed 23% in order not to detract from high temperature tensile ductility and stress rupture strength. The chromium content can extend down to about 19% without loss of corrosion resistance. Chromium plays a dual role in this alloy range of contributing to the protective nature of the $Al_2O_3$—$Cr_2O_3$ scale and to the formation of strengthening by $Cr_7C._3$. For these reasons, chromium must be present in the alloy in the optimal range of 19 to 23%.

Aluminum markedly improves carburization and oxidation resistance. It is essential that it be present in amounts of at least 3% for internal oxidation resistance. As in the case with chromium, aluminum percentages below 3% fail to develop the protective scale required for long service life. This is exemplified by the oxidation data presented at 1000° C. for commercial alloys A and B cited in FIG. 1 and at 1100° C. (2000° F.) for the commercial alloys A to C (alloys 601, 617 and 602CA, respectivcly) cited in FIGS. 2 and 3. High aluminum levels detract from toughness after exposure at intermediate temperatures. Therefore, aluminum is limited to 4.4% to ensure adequate toughness during service life. Furthermore, high aluminum levels detract from the alloy's hot workability.

The combination of 19 to 23% chromium plus 3 to 4% aluminum is critical for formation of the stable, highly protective $Al_2O_3$—$Cr_2O_3$ scale. A $Cr_2O_3$ scale, even at 23% chromium in the alloy, does not sufficiently protect the alloy at high temperatures due to vaporization of the scale as $CrO_3$ and other subspecies of $Cr_2O_3$. This is particularly exemplified by alloy A and to some degree by alloys B and C in FIG. 3. When the alloy contains less than about 3% aluminum, the protective scale fails to prevent internal oxidation of the aluminum. Internal oxidation of aluminum over a wide range of partial pressures of oxygen, carbon and temperature can be avoided by adding at least 19% chromium and at least 3% aluminum to the alloy. This is also important for ensuring self-healing in the event of mechanical damage to the scale.

Iron should be present in the range of about 18 to 22%. It is postulated that iron above 22% preferentially segregates at the grain boundaries such that its carbide composition and morphology are adversely affected and corrosion resistance is impaired. Furthermore, since iron allows the alloy to use ferrochromium, there is an economic benefit for allowing for the presence of iron. Maintaining nickel at a minimum of 50% and chromium plus iron at less than 45% minimizes the formation of alpha-chromium to less than 8 mole percent at temperatures as low as 500° C. (932° F.), thus aiding maintenance of intermediate temperature tensile ductility. Furthermore, impurity elements such as sulfur phosphoras should be kept at the lowest possible levels consistent with good melt practice.

Niobium, in an amount up to 2% contributes to the formation of a stable (Ti,Cb)(C,N) which aids high temperature strength and in small concentrations has been found to enhance oxidation resistance. Excess niobium however can contribute to phase instability and over-aging. Titanium, up to 0.4%, acts similarly. Unfortunately, titanium levels above 0.4% decrease the alloy's mechanical properties.

Optionally, zirconium up to 0.4 acts as a carbonitride former. But more importantly, serves to enhance scale adhesion and retard cation diffusion through the protective scale, leading to a longer service life.

Carbon at 0.05% is essential in achieving minimum stress rupture life. Most advantageously, carbon of at least 0.1% increases stress rupture strength and precipitates as 1 to 5 mole percent $Cr_7C_3$ for high temperature strength. Carbon contents in excess of 0.5% markedly reduce stress rupture life and lead to a reduction in ductility at intermediate temperatures.

Boron is useful as a deoxidizer up to about 0.01% and can be utilized to advantage for hot workability at higher levels.

Cerium in amounts up to 0.1% and yttrium in amounts up to 0.3% play a significant role in ensuring scale adhesion under cyclic conditions. Most advantageously, total cerium and yttrium is at least 50 ppm for excellent scale adhesion. Furthermore, limiting total cerium and yttrium to 300 ppm improves fabricability of the alloy. Optionally, it is possible to add cerium in the form of a misch metal. This introduces lanthanum and other rare earths as incidental impurities. These rare carths can have a small beneficial effect on oxidation resistance.

Manganese, used as a sulfur scavenger, is detrimental to high temperature oxidation resistance, if present in amounts exceeding about 2%. Silicon in excess of 1.5% can lead to embrittling grain boundary phases, while minor silicon levels can lead to improved oxidation and carburization resistance. Silicon should most advantageously be held to less than 1% however, in order to achieve maximum grain boundary strength.

Table 1 below summarizes "about" the alloy of the invention.

TABLE 1

| | Broad | Intermediate | Narrow |
|---|---|---|---|
| Ni | 50–60* | 50–60* | 50–60* |
| Cr | 19–23 | 19–23 | 19–23 |
| Fe | 18–22 | 18–22 | 18–22 |
| Al | 3–4.4 | 3–4.2 | 3–4 |
| Ti | 0–0.4 | 0–0.35 | 0–0.3 |
| C | 0.05–0.5 | 0.07–0.4 | 0.1–0.3 |
| Ce | 0–0.1** | 0.002–0.07*** | 0.0025–0.05 |
| Y | 0–0.3** | 0.002–0.25*** | 0.0025–0.2 |
| Zr | 0.0005–0.4 | 0.0007–0.25 | 0.001–0.15 |
| Nb | 0–2 | 0–1.5 | 0–1 |
| Mn | 0–2 | 0–1.5 | 0–1 |
| Si | 0–1.5 | 0–1.2 | 0–1 |
| N | 0–0.1 | 0–0.07 | 0–0.03 |
| Ca + Mg | 0–0.5 | 0–0.2 | 0–0.1 |
| B | 0–0.1 | 0–0.05 | 0–0.01 |

*Plus Incidential Impurities
**Ce + Y = 0.002 to 0.4%
***Ce + Y = 0.005 to 0.3%

A series of four 22.7 kg (50 lb) heats (Alloys 1 through 4) was prepared using vacuum melting. The compositions are given in Table 2.

TABLE 2

| Nominal Composition of Alloys in This Patent Application | | | | | | | | | | | | | | | |
|---|---|---|---|---|---|---|---|---|---|---|---|---|---|---|---|
| HEAT | C | Mn | Fe | Si | Ni | Cr | Al | Ti | Mg | Nb | Zr | N | Ce | Y | Other |
| 1 | 0.10 | 0.09 | 20.2 | 0.33 | 54.6 | 21.1 | 3.38 | 0.14 | 0.0111 | 0.004 | 0.0033 | 0.021 | 0.0210 | 0.0010 | |
| 2 | 0.13 | 0.10 | 20.6 | 0.31 | 54.2 | 21.0 | 3.46 | 0.15 | 0.0072 | 0.005 | 0.0129 | 0.016 | 0.0170 | 0.0010 | |
| 3 | 0.27 | 0.07 | 20.4 | 0.27 | 53.8 | 21.4 | 3.57 | 0.15 | 0.0108 | 0.004 | 0.0038 | 0.025 | — | 0.0019 | |
| 4 | 0.22 | 0.12 | 20.6 | 0.16 | 53.7 | 21.2 | 3.62 | 0.14 | 0.0118 | 0.004 | 0.0026 | 0.022 | — | 0.0588 | |
| A | 0.04 | 0.2 | 14 | 0.2 | 61.0 | 23.0 | 1.4 | 0.4 | — | — | — | 0.03 | — | — | |
| B | 0.09 | — | 1.0 | 0.1 | 52.0 | 22.0 | 1.2 | 0.4 | — | — | — | — | — | — | 9.5 Mo, 12.5 Co |
| C | 0.19 | 0.10 | 9.9 | 0.12 | 61.9 | 25.0 | 2.38 | 0.17 | 0.0120 | 0.000 | 0.0778 | 0.023 | — | 0.0500 | |

Alloys 1 through 4 were solution annealed 16 hours at 1150° C. (2192° F.) and then hot worked from a 1175° C. (2 150° F.) furnace temperature. Alloys A to C represent the comparative alloys 601, 617 and 602 C.A. The 102 mm (4 in) square×length ingots were forged to 20.4 mm (0.8 in) diameter×length rod and given a final anneal at 1100° C. (2012° F.) for one hour followed by an air cool. The microstructure of alloys 1 to 4 consisted of a dispersion of granular $Cr_7C_3$ in an austenitic grain structure.

Standard tensile and stress rupture test specimens were machined from the annealed alloy rods. The room temperature tensile properties of alloys 1 through 4 along with those of selected commercial alloys from Table 2 are presented in Table 3 below.

TABLE 3

| Room Temperature Tensile Data | | | | | |
|---|---|---|---|---|---|
| | Yield Strength | | Tensile Strength | | Elongation, |
| Alloy | Mpa | ksi | Mpa | ksi | Percent |
| 1 | 419 | 60.7 | 887 | 128.6 | 36.6 |
| 2 | 459 | 66.6 | 932 | 135.1 | 30.7 |
| 3 | 493 | 71.5 | 945 | 137 | 29.2 |
| 4 | 408 | 59.2 | 859 | 124.6 | 33.4 |
| A | 290 | 42.0 | 641 | 93.0 | 52.0 |
| B | 372 | 54.0 | 807 | 117.0 | 52.0 |
| C | 408 | 59.2 | 843 | 122.3 | 33.9 |

Table 4 presents the 982° C. (11800° F.) or high temperature strength data for the alloys.

TABLE 4

| 982° C. (1800° F.) Tensile Properties Specimens Annealed at 1100° C. (2012° F.)/30 Minutes/Air Cooled) | | | | | |
|---|---|---|---|---|---|
| | Yield Strength | | Tensile Strength | | Elongation, |
| Alloy | Mpa | ksi | Mpa | ksi | Percent |
| 1 | 39.3 | 5.7 | 66.2 | 9.6 | 67.1 |
| 2 | 41.4 | 6 | 69.0 | 10 | 59.9 |
| 2* | 52.4 | 7.6 | 79.3 | 11.5 | 81.0 |
| 3 | 39.3 | 5.7 | 66.2 | 9.6 | 61.6 |
| 4 | 35.2 | 5.1 | 59.3 | 8.6 | 117.8 |
| A | 69.0 | 10 | 75.8 | 11 | 100 |
| B | 96.5 | 14.0 | 186 | 27.0 | 92.0 |
| C | 41.0 | 6 | 80.7 | 11.7 | 52.6 |
| C* | 52.4 | 7.6 | 84.8 | 12.3 | 90.4 |

*Annealed at 1200° C. (2192° F.)/1 hour/water quench

The data of Tables 3 and 4 illustrate that the alloy has acceptable strength at room temperature and elevated temperatures.

TABLE 5

| 982° C. (1800° F.) Stress Rupture Properties Specimens Annealed 1100° C. (2012° F.)/30 Minutes/Air Cooled Test Conditions: 13.8 MPa (2 ksi)/982° (1800° F.) | | |
|---|---|---|
| Alloy | Time to Failure, Hours | Elongation, Percent |
| 1 | 393 | 93 |
| | 802 | 108 |
| 2 | 1852 | 92 |
| 3 | 772 | 94 |
| | 860 | 105 |
| C | 169 | 69 |

With regard to the stress rupture results presented in Table 5, it is observed that the compositions exceed the desired minimum stress rupture life of 200 hours at 982° C. (1800° F.) and 13.8 MPa (2 ksi). Analysis of the data show that carbon levels near 0.12% yield the longest stress rupture life, but values to 0.5 are satisfactory.

Figure 2:
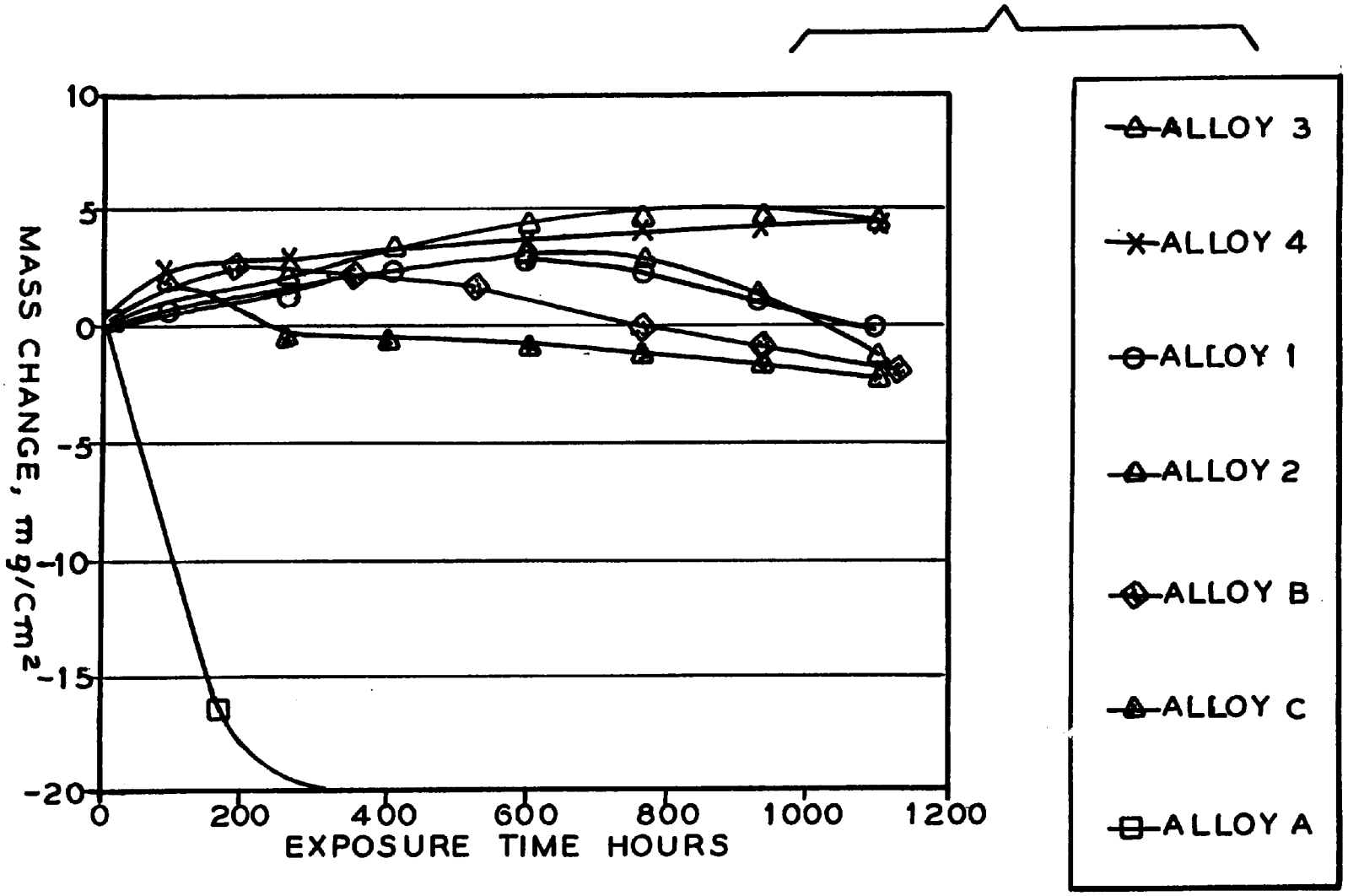
FIG. 2 compares mass change of alloys in air -5% $H_2O$ at a temperature of 1100° C.
Figure 3:
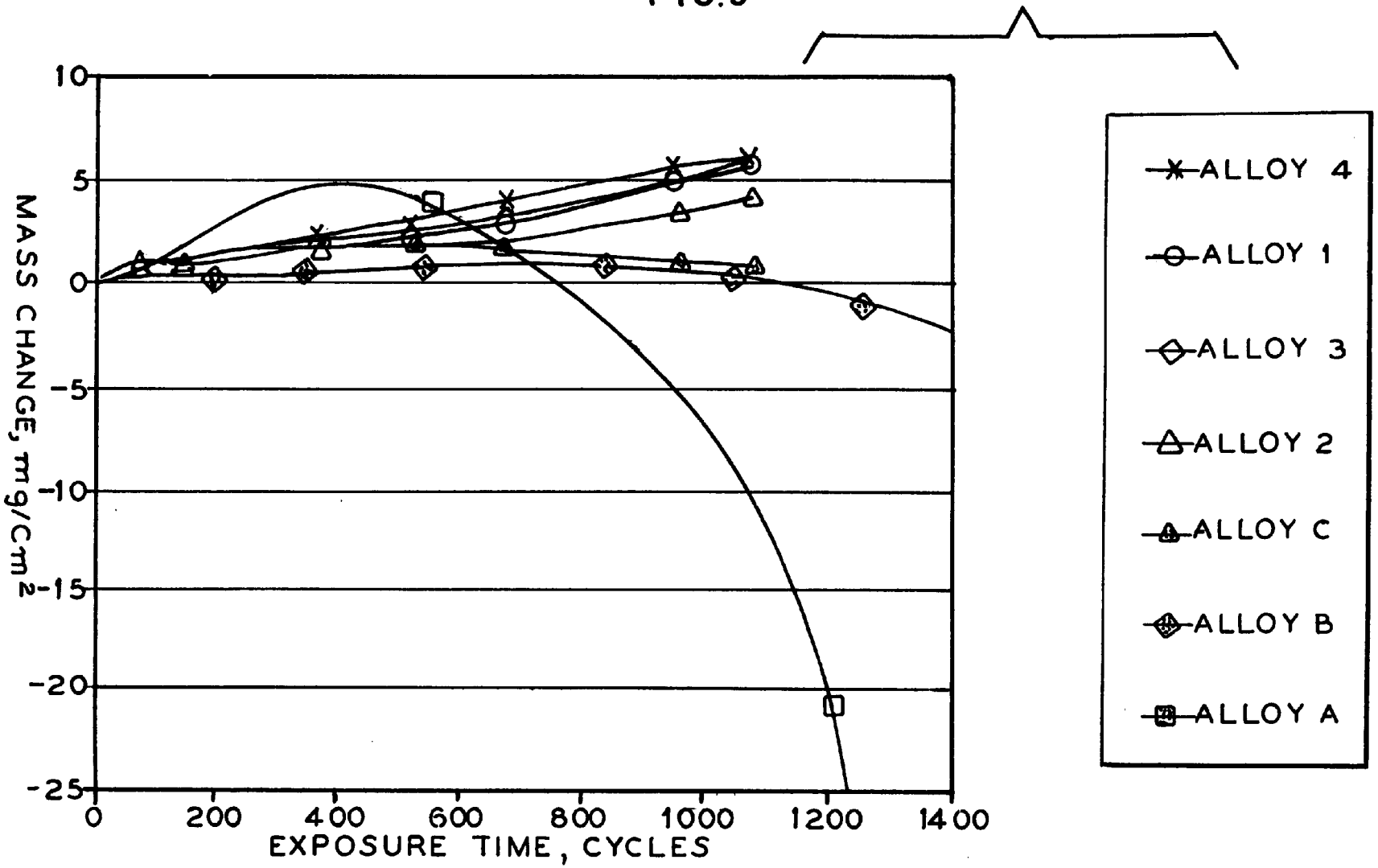
FIG. 3 compares mass change of alloys in air for alloys cycled 15 minutes in and 5 minutes out at a temperature of 1100° C.
Figure 4:
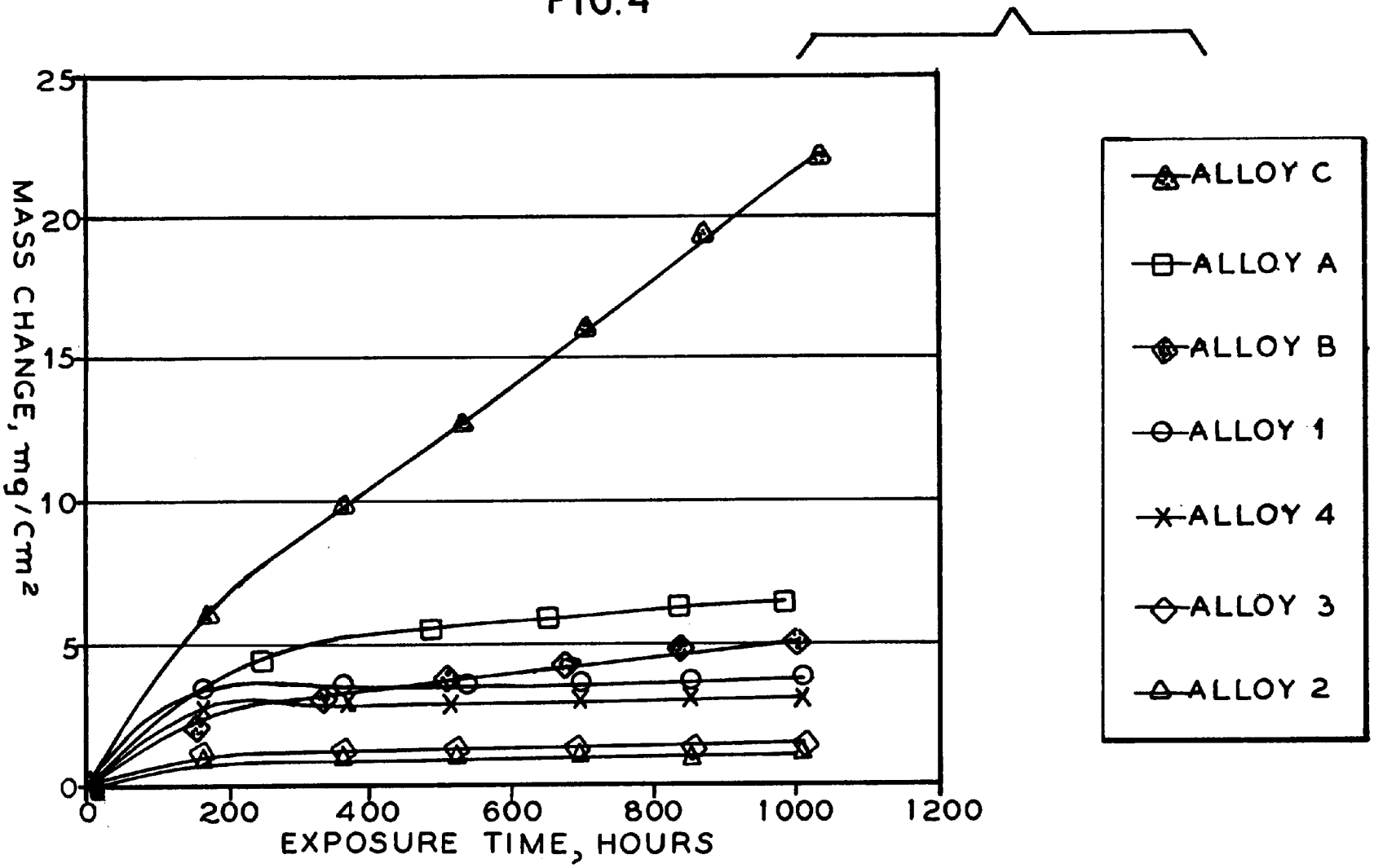
FIG. 4 compares mass change of alloys in $H_2$-5.5% $CH_4$-4.5% $CO_2$ at a temperature of 1000° C.

Oxidation, carburization and cyclic oxidation pins 17.65 mm (0.3 in)×19.1 mm (0.75 in )] were machined and cleaned with acetone. The oxidation pins were exposed for 1000 hours at 1000° C. (1832° F.) and 1100° (2012° F.) in air plus 5% water vapor with periodic removal from the electrically heated mullite furnace to establish mass change as a function of time. The results plotted in FIG. 1 show commercial alloys A and B lacking adequate oxidation resistance. Similarly, cyclic oxidation data depicted in FIG. 3 illustrate alloys 1 through 4 having superior cyclic oxidation to commercial alloys A, B and C. Excellent carburization resistance was established for two atmospheres ($H_2$-1%$CH_4$ and $H_2$-5.5%$CH_4$-4.5%$CO_2$) and at two temperatures [1000° C. (1832° F.) and 1100° C. (2012° F.)]. FIG. 4 illustrates the carburization resistance achieved with the alloy.

In summary, the data in FIGS. 1 to 4 are illustrative of the improvement in carburization and oxidation resistance characteristic of the alloy compositional range. Commercialized alloys A, B and C fail to perform similarly. Resistance to spallation under thermal cycling conditions, as indicated by gradual increases in mass change, is attributed in part to the presence of zirconium plus either cerium or yttrium in critical microalloying amounts.

The alloy range is further characterized as containing 1 to 5 mole percent $Cr_7C_3$, precipitated by heat treatment at temperatures between 950° C. (1742° F.) and 1100° C. (2102° F.), which once formed is stable from room temperature to about the melting point of the alloy range. The protective scale once formed at about the log of $PO_2$ of −32 atm or greater, comprising essentially $Al_2O_3$—$Cr_2O_3$, is resistant to degradation in mixed oxidant atmospheres containing oxygen and carbon species.

While the present patent application has been described with reference to specific embodiments, it is to be understood that modifications and variations may be resorted to without departing from the spirit and scope of the patent application, as those skilled in the art will readily understand. Such modifications and variations are considered to be within the purview and scope of the patent application and appended claims. A given percentage range for an element can be used within a given range for the other constituents. The term incidental impurities used in referring to the alloy range does not exclude the presence of other elements which do not adversely affect the basic characteristics of the alloy, including deoxidizers and rare earths. It is considered that, in addition to the wrought form, this alloy range can be used in the cast condition or fabricated using powvder metallurgy techniques.

We claim:

1. A nickel-base alloy consisting essentially of, by weight percent, about 50 to 60 nickel, about 19 to 23 chromium, about 18 to 22 iron, about 3 to 4.4 aluminum, about 0 to 0.4 titanium, about 0.05 to 0.5 carbon, about 0.002 to 0.1 cerium, about 0.001 to 0.3 yttrium, about 0.005 to 0.4 total cerium plus yttrium, about 0.0005 to 0.4 zirconium, about 0 to 2 niobium, about 0 to 2 manganese, about 0 to 1.5 silicon, about 0 to 0.1 nitrogen, about 0 to 0.5 calcium and magnesium, about 0 to 0.1 boron and incidental impurities; and said alloy forming about 1 to 5 mole percent $Cr_7C_3$ after 24 hours at a temperature between about 950 and about 1150° C. for high temperature strength.

2. The nickel-base alloy of claim 1 containing about 3 to 4.2 aluminum, about 0 to 0.35 titanium and about 0 to 1.5 niobium.

3. The nickel-base alloy of claim 1 containing about 0.002 to 0.07 cerium, about 0.002 to 0.25 yttrium, about 0.005 to 0.3 total cerium plus yttrium and about 0.0007 to 0.25 zirconium.

4. The nickel-base alloy of claim 1 having a stress rupture life of at least 200 hours at a temperature of 982° C. and at a stress of 13.8 MPa.

5. A nickel-base alloy consisting essentially of, by weight percent, about 50 to 60 nickel, about 19 to 23 chromium, about 18 to 22 iron, about 3 to 4.2 aluminum, about 0 to 0.35 titanium, about 0.07 to 0.4 carbon, about 0.002 to 0.07 cerium, about 0.002 to 0.25 yttrium, about 0.005 to 0.3 total cerium plus yttrium, about 0.0007 to 0.25 zirconium, about 0 to 1.5 niobium, about 0 to 1.5 manganese, about 0 to 1.2 silicon, about 0 to 0.07 nitrogen, about 0 to 0.2 calcium and magnesium, about 0 to 0.05 boron and incidental impurities; and said alloy forminig about 1 to 5 mole percent $Cr_7C_3$ after 24 hours at a temperature between about 950 and about 1150° C. for high temperature strength.

6. The nickel-base alloy of claim 5 containing about 3 to 4 aluminum, about 0 to 0.3 titanium and about 0 to 1 niobium.

7. The nickel-base alloy of claim 5 containing about 0.0025 to 0.05 cerium, about 0.0025 to 0.2 yttrium and about 0.001 to 0.15 zirconium.

8. The nickel-base alloy of claim 5 having a stress rupture life of at least 200 hours at a temperature of 982° C. and at a stress of 13.8 MPa.

9. A nickel-base alloy consisting essentially of, by weight percent, about 50 to 60 nickel, about 19 to 23 chromium, about 18 to 22 iron, about 3 to 4 aluminum, about 0 to 0.3 titanium, about 0.1 to 0.3 carbon, about 0.0025 to 0.05 cerium, about 0.0025 to 0.2 yttrium, about 0.001 to 0.15 zirconium, about 0 to 1 niobium, about 0 to 1 manganese, about 0 to 1 silicon, about 0 to 0.03 nitrogen, about 0 to 0.1 calcium and magnesium, about 0 to 0.01 boron and incidental impurities; and said alloy forming about 1 to 5 mole percent $Cr_7C_3$ after 24 hours at a temperature between about 950 and about 1150° C. for high temperature strength.

10. The nickel-base alloy of claim 9 having a stress rupture life of at least 200 hours at a temperature of 982° C. and at a stress of 13.8 MPa.

* * * * *